US005501272A

United States Patent [19]

Coutts et al.

[11] Patent Number: 5,501,272

[45] Date of Patent: Mar. 26, 1996

[54] MULTI-SENSOR RELIEF VALVE WELL TEST SYSTEM

[75] Inventors: Graeme F. Coutts; Jeffrey C. Edwards, both of Scotland, United Kingdom

[73] Assignee: Expro North Sea Limited, Scotland

[21] Appl. No.: 199,242

[22] PCT Filed: Jul. 23, 1992

[86] PCT No.: PCT/GB92/01353

§ 371 Date: Mar. 25, 1994

§ 102(e) Date: Mar. 25, 1994

[87] PCT Pub. No.: WO93/05273

PCT Pub. Date: Mar. 18, 1993

[30] Foreign Application Priority Data

Aug. 31, 1991 [GB] United Kingdom ..... 9118692

[51] Int. Cl.[6] ..... E21B 49/00

[52] U.S. Cl. ..... 106/250.01

[58] Field of Search ..... 166/250–253, 166/373–375, 86, 87, 95, 317, 325–329, 386; 251/51–53, 58, 315.01; 137/613, 614, 614.19

[56] References Cited

U.S. PATENT DOCUMENTS

| | | | |
|---|---|---|---|
| 3,980,416 | 9/1976 | Goncalves et al. | 431/202 |
| 4,624,317 | 11/1986 | Barrington | 166/373 X |
| 4,658,904 | 4/1987 | Doremus et al. | 166/374 X |
| 4,711,305 | 12/1987 | Ringgenberg | 166/373 X |
| 4,727,489 | 2/1988 | Frazier et al. | 364/422 |
| 4,802,359 | 2/1989 | Patrice | 166/250 X |

FOREIGN PATENT DOCUMENTS 2202236 10/1973 France .

OTHER PUBLICATIONS

Developments in Plastic Machinery (German Publication) 1976, pp. 97–104 (translation included).

*Primary Examiner*—Michael Powell Buiz

*Attorney, Agent, or Firm*—Gifford, Krass, Groh, Sprinkle, Patmore, Anderson & Citkowski

[57] ABSTRACT

A well testing system is described which comprises a ball valve (10) having a plurality of fluid lines coupled thereto (20a, 20b, 20c). The ball valve (10) is located between a process fluid flow line (16) and a vent line (18) with each fluid line (20a, 20b, 20c) being coupled to a respective piece of well-test equipment rated at a certain pressure value. Pressure relief means (22a, 22b, 22c) are located in each fluid line (20a, 20b, 20c) between the piece of equipment and said ball valve (10) and each pressure relief means (22a, 22b, 22c) is operable when the in-line fluid pressure exceeds a predetermined value to pass said fluid to said ball valve (10). The ball valve (10) is actuatable in response to any one of said pressure relief means (22a, 22b, 22c) having fluid passed therethrough whereby the ball valve is actuated to an open position and remains in the open position once actuated, so that the well reservoir fluid/gas mixture from said fluid flow line (16) passes through the ball valve (10) to said vent line (18).

10 Claims, 3 Drawing Sheets

MULTI-SENSOR RELIEF VALVE WELL TEST SYSTEM

BACKGROUND OF THE INVENTION

1. Field of the Invention

The present invention relates to process safety equipment for hydrocarbon production and in particular, but not exclusively, to a method and apparatus for use with existing well test equipment on temporary process installations.

2. Description of the Related Art

In conventional well testing a considerable amount of equipment is transported to an oil rig and a well test/process situation is set up to test the fluid from the downhole reservoir. A typical prior art test system is shown in FIG. 1 where a number of well test components such as a steam exchanger, a test separator and a surge tank are provided as part of the well test equipment. As each component has a different pressure rating—it is important to monitor the pressure in each of the components such that if an over-pressure situation occurs at any piece of equipment, a safety valve is actuated which vents the over-pressure fluid to atmosphere via the rig relief burner boom. With the system shown in FIG. 1 separate safety valves are coupled to each component. If there are a large number of components this will require an equally large number of safety valves and the monitoring and coupling of such valves is a disadvantage in a rig environment. In addition, in existing well test systems certain parts of the system are ignored and it is assumed that safety valves are not required to be coupled thereto, for example the coil of the heat exchanger. In addition, the safety valves are of the same design and are representative of the prior art.

A common safety valve used is the SPM emergency relief valve which is a spring-operated device using a hardened ball and seat sealing area. The ball is held fast against the seat by valve springs and remains seated until upstream pressure equals the set pressure. At this point the ball begins to unseat to allow liquid to relieve. As upstream pressure increases, the ball compresses a spring and travels away from the seat until an equilibrium is met that allows a given amount of liquid to pass at a pressure above the valve setting. When the pressure drops below the set pressure, the valve reseats. These existing valves are primarily designed to vent liquid and they are not designed to vent multi-phase fluids, such as that in a hydrocarbon production line which is generally a fluid/gas mixture. In addition, these valves do not lock open and are designed for venting relatively low volume. When there is a liquid gas mixture combination and the fluid is at high pressure, the depressurisation curve is very steep so that when the valve initially opens the throttling effect causes the temperature of the gas to fall to such a level that the fluid freezes up and venting does not occur. In this situation the pressure is retained and the well test equipment is then likely to fail at the next weakest point which is probably the piece of the equipment which the valve is intended to protect. In general the downstream side of each piece of equipment is not rated to an equal pressure as the upstream system and may rupture. In addition, these valves are not particularly accurate in pressure rating because at the start the gas temperature may be −40° F. and this temperature can change to +250° F. within half an hour to an hour of start up. The valves are not repeatable and the valve operating point changes because of thermal stress so that venting is or will be unpredictable.

A further problem with the prior art arrangement is that there is no in-line block valve which means that pressure tests can only be carried out at a value less than the safety valve threshold with the result that the valve rating for a fully open position cannot be checked. With the arrangement shown in FIG. 1 only the part of the well test equipment to which the valve is attached is protected and, consequently, many safety valves are required, for example in FIG. 1, six safety valves $SV_1$–$SV_6$, are shown and this only provides partial protection for the system.

It is an object of the present invention to provide a well test system in which the requirement of multi-safety valves is obviated and which allows pressure testing to be carried out at and above the pressure to the full value of the production line portion in which the valve is situated.

Another object of the present invention is to provide a relief valve which obviates or mitigates at least of the aforementioned disadvantages.

SUMMARY OF THE INVENTION

According to one aspect of the present invention, there is provided a well testing system comprising a ball valve having a plurality of fluid lines coupled thereto, said ball valve being located between a process fluid flow line and a vent line, each fluid line being coupled to a respective piece of equipment rated at a certain pressure value, pressure relief means located in each fluid line between the piece of equipment and said ball valve, each pressure relief means being operable when the in-line fluid pressure exceeds a predetermined value to pass said fluid to said ball valve, said ball valve being actuatable in response to any one of said pressure relief means having fluid passed therethrough whereby the ball valve is actuated to an open position and remains in the open position once actuated, so that the well reservoir fluid/gas mixture from said fluid flow line passes through the ball valve to said vent line.

Preferably, each fluid line is coupled to a separate piece of well-test equipment and said pressure relief means includes rupture disc means rated for the pressure of the element to which it is connected.

Conveniently, each fluid line is provided by stainless steel tubing which may be stored in drums and rolled out for use. The stainless steel tubing line has conventional fittings on the end for connection to the well test equipment.

Preferably, each ball valve includes an apertured ball element rotatably mounted in a valve housing, said ball element being rotatable in response to pressure from a line in which fluid passes through a ruptured disc via a one way valve to rotate the ball element to an open position and which remains thereat until reset.

Conveniently, the ball valve includes a cylindrical piston which is rectilinearly moveable, said piston being coupled to the ball element so that in response to applied pressure from a fluid line, rectilinear movement of the cylindrical piston is converted to rotary movement of the ball element.

Preferably, a plurality of fluid line inlet ports are disposed around the periphery of valve housing, each of said inlet ports being adapted to be connected to a respective fluid line, and said piston means being responsive to an increase in pressure from any of said ports to actuate said ball valve element to an open position.

Preferably also, a reset and/or observation port is disposed in said valve housing said reset port being adapted to be coupled to a further pressurised fluid line so that when pressure is applied, said cylindrical piston and ball valve may be restored to a closed position.

According to another aspect of the present invention there is provided a method of monitoring pressure a plurality of well test components in a well test arrangement and for relieving over-pressure from any monitored component, said method comprising the steps of:

providing a ball valve coupled between a flow line and a vent line, coupling fluid lines between said ball valve and each piece of equipment to be protected, providing predetermined pressure relief means in each fluid line, the value of each predetermined pressure relief means being determined by the rating of the piece of equipment to which it is coupled, and actuating said ball valve to an open position in response to a signal from any pressure relief means so that flow from said flow line is vented through said ball valve to said vent line.

Preferably said method includes step of restoring said ball valve to closed position after said over pressure has been vented through said valve.

According to another aspect of the present invention there is provided a pressure relief valve for use in a well test system, said pressure relief valve comprising a valve housing, an apertured rotatable ball element which is captive in said valve housing, piston means located in said valve housing, said piston means being coupled to the ball valve element, at least one fluid line inlet port in said valve housing which passes through a wall of said housing, said at least one fluid line inlet port being adapted to be coupled to a fluid line whereby said piston is moveable in response to pressure in said line exceeding a predetermined value, and movement of the piston within said valve housing causes said ball valve element to rotate from an closed position to an open position.

Preferably said pressure relief valves include a reset port located in said valve housing, said reset port being adapted to be coupled to another pressured fluid line for resetting the piston and moving the ball to its closed position.

Preferably there are provided a plurality of fluid line inlet ports disposed around the periphery of said valve housing, each of said plurality of fluid line inlet ports being coupled to a fluid line so that pressure in any one of said lines which exceeds the value for the equipment coupled to that line may actuate the cylindrical piston to operate and open said ball valve.

Conveniently, said valve housing has a flange at each end to which the valve housing can be coupled to a flow line and to a vent pipe.

BRIEF DESCRIPTION OF THE DRAWING

These and other aspects of the present invention will become apparent from the following description when taken in combination with the accompanying drawings.

DESCRIPTION OF THE PREFERRED EMBODIMENTS

Figure 2:
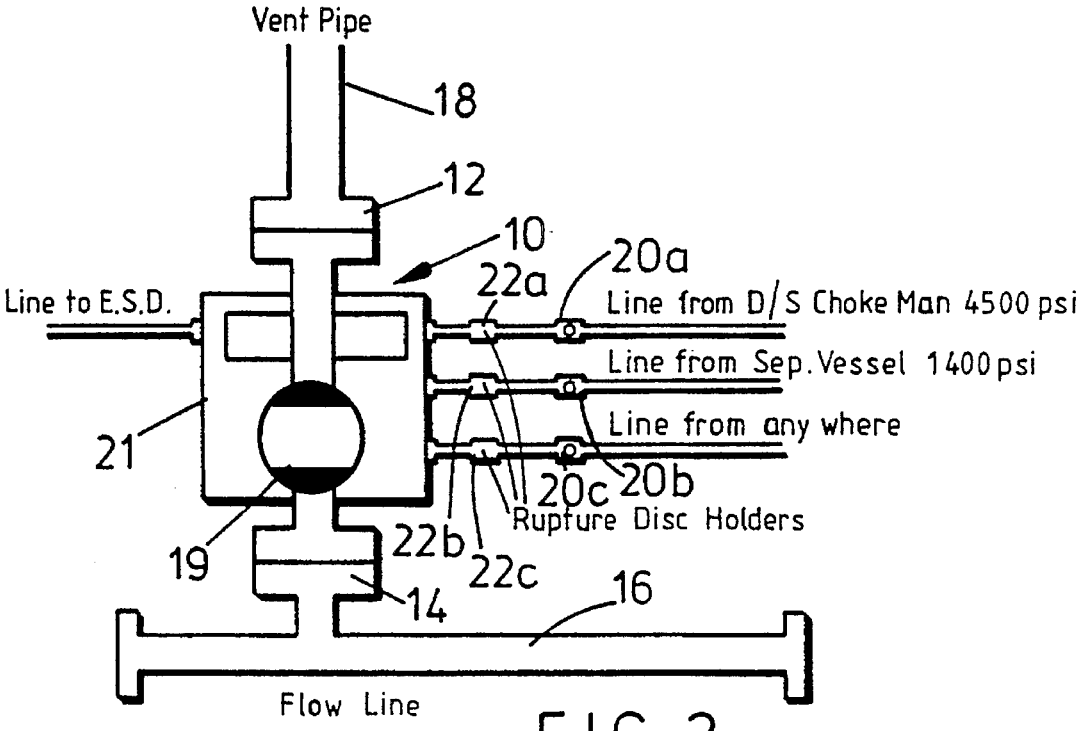
FIG. 2 is a schematic diagram of an embodiment of a well test system in accordance with the present invention.

Reference is first made to FIG. 2 of the accompanying drawings which depicts a preferred embodiment of a multi-sensor pressure relief valve in accordance with the present invention. The pressure relief valve, generally indicated by reference numeral 10, is coupled by flange connections 12 and 14 to a fluid flow line 16 and a vent pipe 18. As is well known, the vent pipe 16 is fed out to the rig relief burner booms. The pressure relief valve 10 is a ball valve and has an apertured ball element 11 disposed in a valve housing 21, has a plurality of fluid inlet lines connected thereto of which three, 20*a*, 20*b* and 20*c*, are shown. Each of the lines 20*a*, *b*, and *c* is connected to a particular piece of equipment (not shown) which is desired to be protected from over-pressure. Each line 20*a*, *b* and *c* is made of stainless steel which may be rolled from a drum during installation and is connected to pieces of equipment using existing tappings on the equipment. Each line includes a pressure sensor in the form of a rupture disc which is disposed in rupture discs holders 22*a*, *b* and *c*. These discs are designed to rupture at a predetermined temperature and pressure and communicate the over-pressure fluid to the safety relief valve 10.

If there is fluid over-pressure in any particular piece of equipment, then the disc in the fluid line connected to that piece of equipment will rupture and pressure is applied to the relief valve 10 to actuate the ball valve element 19 therein to an open position so that pressure in flow line 16 is vented through the vent pipe 18 as will be later described in detail.

Figure 1:
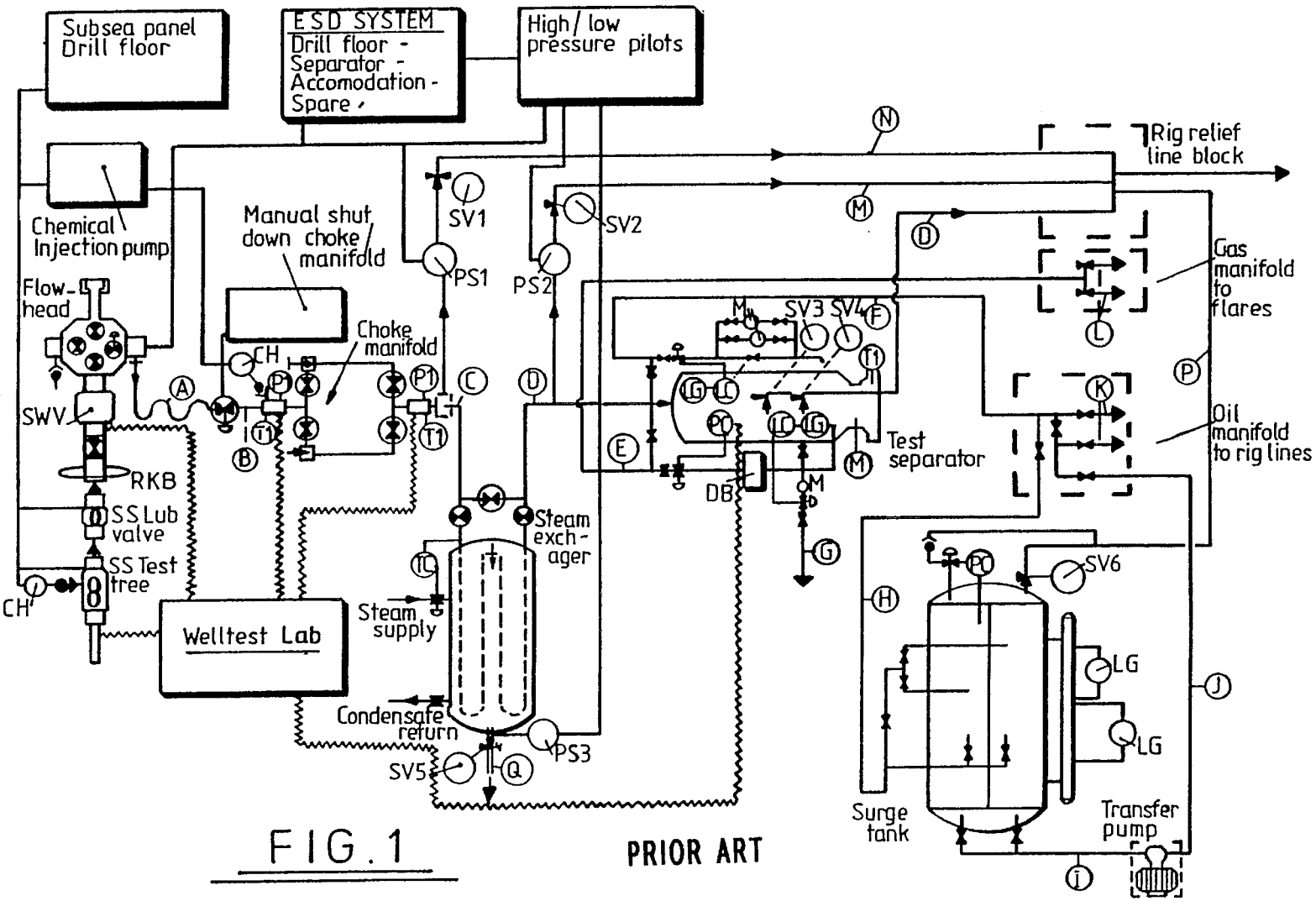
FIG. 1 is a schematic diagram of a well test system and safety equipment in accordance with a prior art arrangement.
Figure 3:
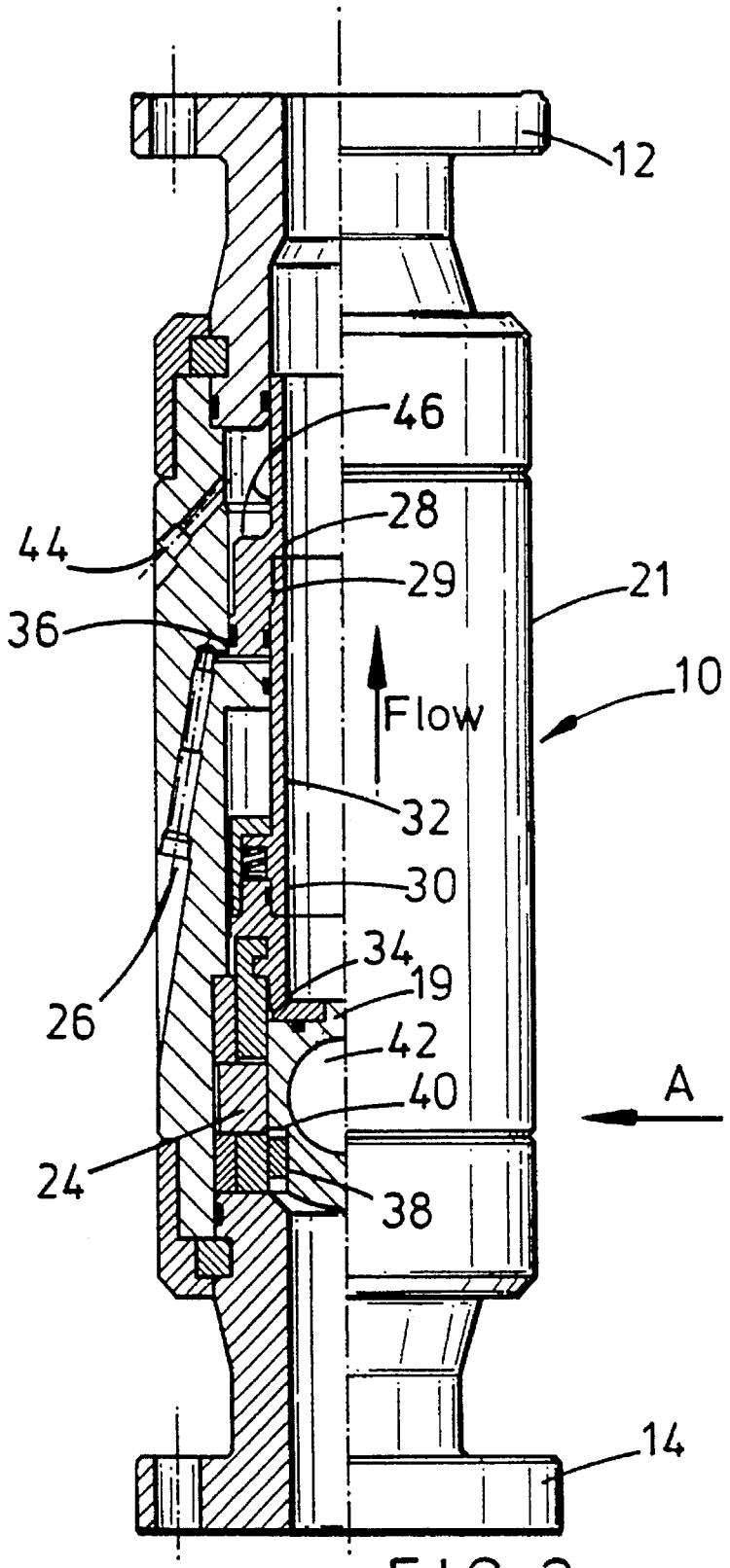
FIG. 3 is an enlarged and partly longitudinal sectional view of a pressure relief valve shown in FIG. 2 in accordance with a preferred embodiment of the present invention.

Reference is now made to FIG. 3 of the drawings which is a longitudinal split sectional view through the relief valve 10 shown in FIG. 1. As mentioned above, the relief valve 10 is a ball valve which contains the apertured ball valve element 19 which is mounted by pivot pins 24 in the valve housing, one of which is shown for rotation about the pin axis. In FIG. 3 the valve is shown in a closed position. The remaining valve structure will best be described with reference to the operation of the valve which occurs when there is an over-pressure situation.

The valve housing 21 is generally cylindrical and includes a plurality of fluid inlet ports 26 disposed around the periphery of the housing, although only one is shown in the interest of clarity. The port 26 passes through the wall of the housing 21 and each port is adapted/connected to a fluid inlet line (FIG. 2) which is also coupled to a piece of equipment in which the pressure is to be monitored. Disposed in the bore of the valve 10 is a moveable piston 28 and a valve seating arrangement generally indicated by reference numeral 30 which is moveable up and down within the valve housing with piston 28. The piston 28 has a threaded inside face 29 and is coupled to a cylindrical sleeve 32 which is coupled to the seating arrangement 30 which, in turn, has a seating face 34 shown abutting the ball valve element 19.

Figure 4:
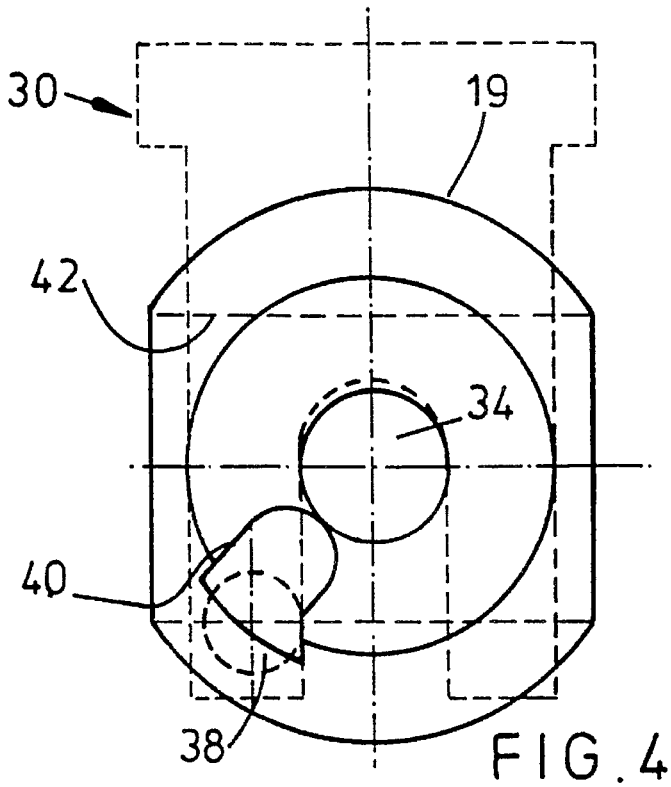
FIG. 4 is an enlarged side view of the ball valve taken in the direction of arrow A in FIG. 3.

In the event of over-pressure occurring in any particular line, for example line 20*b* from the separator vessel such that the pressure exceeds 1400 p.s.i., the ruptured disc in holder 22*b* ruptures and pressure is applied to fluid inlet port 26. The pressure is applied to the bottom face 36 of the piston 28, and because the other side of the piston is at atmospheric pressure, the applied pressure forces the piston 28 upwards within the bore of the valve 10. As the piston 28 is forced upwards it carries sleeve 32 and seating arrangement 30 upward such that the valve seat 34 moves free of the ball element 19. In addition, as best seen in FIG. 4, as the valve seating arrangement 30 moves upwards pins 38 which are located in oblique slots 40 in the ball 19 and which cause the ball element 19 to rotate within the valve housing 21 such that the central aperture 42 in the ball valve element 19 clears the valve seat 34 so that fluid in the flow line 16 passes through the ball element aperture 42 and through the bore of the relief valve to the vent pipe 18.

As long as there is over-pressure the valve 10 remains fully open until the pressure in the system is reduced to zero. Once this occurs the ball valve requires to be reset to the closed position and this is achieved by applying pressure to the observation and/or reset port 44, located in the valve housing 21 above the fluid inlet port 36. When pressure is applied to this port it acts on the upper surface 46 of the piston and forces the piston, sleeve 32 and seating arrangement 30 down so that valve seat 34 again seats against the ball element 11 which have been rotated by the pin 38 and slot 40 arrangement to the closed position, so that the valve is again ready for use.

Thus, it will be appreciated that a considerable advantage of this arrangement is that a single pressure relief valve is used which is located in the line which may be tested at and above the operating pressure of the valve to the full value of the production line portion in which it is situated. In addition, various pieces of well test equipment may be coupled through fluid lines to the operating ports on the safety valve element as required and each piece of equipment can be set to provide an over-pressure signal at a predetermined value by inserting a suitable value of rupture disc in the line. In addition, once the ball valve is actuated is remains in the fully open position until reset and the relief valve can readily be inspected using the observation port to see whether the valve is functional.

We claim:

1. A well testing system comprising a ball valve having a plurality of fluid lines coupled thereto, said ball valve being located between a process fluid flow line and a vent line, each fluid line being coupled to a respective piece of equipment rated at a certain pressure value, pressure relief means located in each fluid line between the piece of equipment and said ball valve, each pressure relief means being operable when an in-line fluid pressure exceeds a predetermined value to pass said fluid to said ball valve, said ball valve being actuatable in response to any one of said pressure relief means having fluid passed therethrough whereby the ball valve is actuated to an open position and remains in the open position once actuated, so that the well reservoir fluid/gas mixture from said fluid flow line passes through the ball valve to said vent line.

2. A system as claimed in claim 1 wherein each fluid line is coupled to a separate piece of well-test equipment and said pressure relief means includes rupture disc means rated for the pressure of the element to which it is connected.

3. A system as claimed in claim 1 wherein each fluid line is provided by stainless steel tubing which is stored in drums and rolled out for use.

4. A system as claimed in claim 3 wherein the stainless steel tubing line has conventional fittings on the end connection to the well test equipment.

5. A system as claimed in claim 1 wherein each ball valve includes an apertured ball element rotatably mounted in a valve housing, said ball element being rotatable in response to pressure from a line in which fluid passes through a ruptured disc via a one valve to rotate the ball element to an open position and which remains thereat until reset.

6. A system as claimed in claim 5 wherein the ball valve includes a cylindrical piston which is rectlinearly moveable, said piston being coupled to the ball element so that in response to applied pressure from a fluid line, rectilinear movement of the cylindrical piston is converted to rotary movement of the ball element.

7. A system as claimed in claim 6 wherein a plurality of fluid line inlet ports are disposed around the periphery of valve housing, each of said inlet ports being adapted to be connected to a respective fluid line, and said piston means being responsive to an increase in pressure from any of said ports to actuate said ball valve element to an open position.

8. A system as claimed in claim 6 wherein a reset and/or observation port is disposed in said valve housing said reset port being adapted to be coupled to a further pressured fluid line so that then pressure is applied, said cylindrical piston and ball valve may be restored to a closed position.

9. A method of monitoring pressure a plurality of well test components in a well test arrangement and for relieving over-pressure from any monitored component, said method comprising the steps of:

providing a ball valve coupled between a flow line and a vent line, coupling fluid lines between said ball valve and each piece of equipment to be protected, providing predetermined pressure relief means in each fluid line, the value of each predetermined pressure relief means being determined by the rating of the piece of equipment to which it is coupled, and actuating said ball valve to an open position in response to a signal from any pressure relief means so that flow from said flow line is vented through said ball valve to said vent line.

10. A method as claimed in claim 9 wherein said method includes step of restoring said ball valve to closed position after said over pressure has been vented through said valve.

* * * * *